US005334496A

United States Patent [19]

Pond et al.

[11] Patent Number: 5,334,496

[45] Date of Patent: Aug. 2, 1994

[54] PROCESS AND APPARATUS FOR REPRODUCIBLE PRODUCTION OF NON-UNIFORM PRODUCT DISTRIBUTIONS

[75] Inventors: Karen L. Pond, Pittsford; Alton L. Chitty, Rochester; Douglas L. Oehlbeck, Rochester; Marian S. Henry, Rochester; Ward K. Darron, Rush, all of N.Y.

[73] Assignee: Eastman Kodak Company, Rochester, N.Y.

[21] Appl. No.: 946,760

[22] Filed: Sep. 17, 1992

[51] Int. Cl.[5] ..... G03C 1/015; B01F 5/10

[52] U.S. Cl. ..... 430/569; 366/136; 366/137

[58] Field of Search ..... 366/136, 137, 142, 159; 430/569

[56] References Cited

U.S. PATENT DOCUMENTS

| | | | |
|---|---|---|---|
| 3,790,386 | 2/1974 | Posse et al. | 430/569 |
| 3,821,002 | 6/1974 | Culhane et al. | 430/569 |
| 4,147,551 | 4/1979 | Finnicum et al. | 430/569 |
| 4,171,224 | 10/1979 | Verhille et al. | 430/569 |
| 4,251,627 | 2/1981 | Calamur | 430/569 |
| 4,328,787 | 5/1982 | Bruff et al. | 126/343.5 A |
| 4,379,836 | 4/1983 | Schnöring et al. | 430/569 |
| 4,421,682 | 12/1983 | Edwards et al. | 530/380 |
| 4,664,528 | 5/1987 | Rodgers et al. | 366/142 |
| 4,758,505 | 7/1988 | Hoffmann | 430/569 |
| 4,778,280 | 10/1988 | Brazelton | 366/136 |
| 4,844,620 | 7/1989 | Lissant et al. | 366/136 |
| 4,990,431 | 2/1991 | Bagchi et al. | 430/372 |
| 5,104,786 | 4/1992 | Chronis et al. | 430/569 |

*Primary Examiner*—Charles L. Bowers, Jr.
*Assistant Examiner*—Mark F. Huff
*Attorney, Agent, or Firm*—Paul A. Leipold

[57] ABSTRACT

A method for the reproducible production of nonuniform distributions of polymolecular association clusters, each of the clusters comprising a plurality of a species A in association with a single species B, is disclosed. Species A is preferably a photographic dye and Species B is preferably a silver halide particle. The method comprises: (a) mixing a suspension of particles of species B in a vessel; (b) flowing a portion of the suspension through an isolated reaction zone; (c) introducing species A into the isolated reaction zone; and (d) returning the portion of the suspension including the introduced species A to the vessel. In another aspect, the invention relates to an apparatus for carrying out the foregoing process.

8 Claims, 5 Drawing Sheets

PROCESS AND APPARATUS FOR REPRODUCIBLE PRODUCTION OF NON-UNIFORM PRODUCT DISTRIBUTIONS

BACKGROUND OF THE INVENTION

1. Field of the Invention

The invention relates to a process for reproducibly producing uniform or non-uniform distributions of polymolecular association clusters, in particular, clusters of silver halide particles with photographic addenda. The invention further relates to apparatus for carrying out the process.

2. Information Disclosure

The distribution of photographically active chemicals among silver halide grains in a photographic emulsion significantly affects the sensitometric response of that batch of emulsion. Therefore it is important to be able to control this distribution to ensure batch to batch uniformity of the sensitometric response. An optimal distribution profile is a function of the photographically active chemicals, the emulsion of concern and the intended use. In some instances, it is desirable to have a non-uniform distribution of photographically active chemicals on silver halide particles to produce desired sensitometric effects such as a decrease in contrast. There is a need for a method to produce such a non-uniform distribution in a manner that is both controlled and reproducible from batch to batch.

This can perhaps be better appreciated by reference to FIGS. 1 and 2. FIG. 1 shows a schematic representation of a mixture of eight particles of type B (assumed to be grains of silver halide in a particular case) associated with 40 particles of type A (assumed to be molecules of photographic dye in a particular case). The depiction represents a statistically unlikely situation but conceptually it is simpler than a precise representation of a statistical distribution of a 1:5 stoichiometry of B:A, which would be clustered around the species shown. In some cases it will be desired that the mixture of particles have a distribution as shown in FIG. 2, in which there are still 8 B's and 40 A's. However, although the gross stoichiometry is $BA_5$ the distribution is no longer clustered around 5 A's per B; the distribution is bimodal, comprising half $BA_{10}$ and half B. Consider then a situation in which the desired distribution is to be polymodal. Simple mixing of the two components will not achieve the desired distribution. Individually reacting each stoichiometry for each mode and then mixing the individual batches could be used to furnish repeat batches of non-uniform or polymodal distributions but this is complex and time-consuming. It requires multiple runs with cleanup between each run or multiple reactors at considerable expense. There is thus a need for a simplified method and apparatus to reproducibly furnish non-uniform distributions of polymolecular association clusters.

SUMMARY OF THE INVENTION

It is an object of the invention to provide a method for the reproducible production of non-uniform distributions of polymolecular association complexes.

It is a further object to provide a method whereby one can control the degree of non-uniformity of a distribution of polymolecular association clusters.

It is a further object to provide a method that is simple and does not require multiple reactions and multiple cleanups.

It is a further object to provide a method that does not require multiple sets of expensive apparatus.

It is a further object to provide a simple, reliable apparatus for producing polymodal product distributions.

It is a further object to provide a process that is easily scaled up or down.

These and other objects and features are realized in the instant invention.

In one aspect the invention relates to a method for the reproducible production of non-uniform distributions of polymolecular association clusters, each of the clusters comprising a plurality of a species A in association with a single species B. Species A is preferably a photographically active chemical, most preferably a dye. Species B is preferably a silver halide particle, optimally of 0.1 to 10 μm mean grain size. A particularly desirable form of silver halide grain for some uses is a tabular grain which has an equivalent circular diameter $<10$ μm and an aspect ratio $>8$. By photographically active chemicals are meant the usual addenda that are used in modulating the sensitometric properties of a photographic emulsion; these would include dyes, couplers, sensitizers, brighteners, antifogging agents, and similar chemicals well known to those in the art.

The association cluster arises from a reaction of the form $$nA + B \underset{k^{-1}}{\overset{k^{1}}{\rightleftharpoons}} BA_n \qquad (1)$$

wherein n is an integer, $k^1$ is the rate of forward reaction (association), $k^{-1}$ is the rate of reverse reaction (dissociation), and $k^1 >> k^{-1}$ and the method comprises:

(a) mixing at a rate of P turnovers per minute a suspension of particles of species B at concentration $C_8$ in a suitable solvent volume V in a vessel;

(b) flowing a portion of the suspension through an isolated reaction zone at a rate $r_1 = QV$ per minute for X minutes where Q represents a proportion of the total vessel volume to be passed through the reaction zone per minute, and X is (1/Q) E wherein E represents a number of cycles of full vessel volume to be passed through the isolated reaction zone;

(c) introducing species A into the isolated reaction zone at a rate $r_2 = FC_8V$ per minute, where F represents a desired mole ratio of reactant A to be added; and (d) returning the portion of the suspension including the introduced species A to the vessel.

The constants E, F, P and Q are chosen such that E is a number from 0.01 to 100, F is a number from $10^{-8}$ to $10^{-1}$, P is a number from 0 to 100, and Q is a number from 0.001 to 10. In a preferred process, E is 0.25 to 2.5, F is $10^{-6}$ to $10^{-3}$, and Q is 02 to 2.0 and P is 2 to 30. When E, F, P and Q are properly chosen, the method can also be used to produce precisely controlled uniform distributions.

The isolated reaction zone is calculated and exemplified as a single location or piece of apparatus, but there is no reason, in principle, that it could not be two or more zones that, in the aggregate, exhibit the characteristics described.

In another aspect, the invention relates to an apparatus for carrying out the foregoing process. The apparatus comprises:

(a) a vessel;
(b) means for circulating a suspension within the vessel;
(c) a reaction chamber having an effective volume which is less than the volume of the vessel;
(d) a first conduit connecting the vessel to the chamber;
(e) a second conduit connecting the chamber to the vessel;
(f) means for inducing a flow of a portion of the suspension from the vessel through the first conduit to the chamber and from the chamber through the second conduit returning to the vessel at a first controlled rate; and
(g) means for introducing a reactant into the reaction chamber at a second controlled rate.

In a preferred apparatus, the holding vessel has a volume from 2 to $10^7$ times the effective volume of the mixing chamber.

The apparatus may also comprise means for controlling the temperature or pH of the suspension.

DESCRIPTION OF PREFERRED EMBODIMENTS

Figure 1:
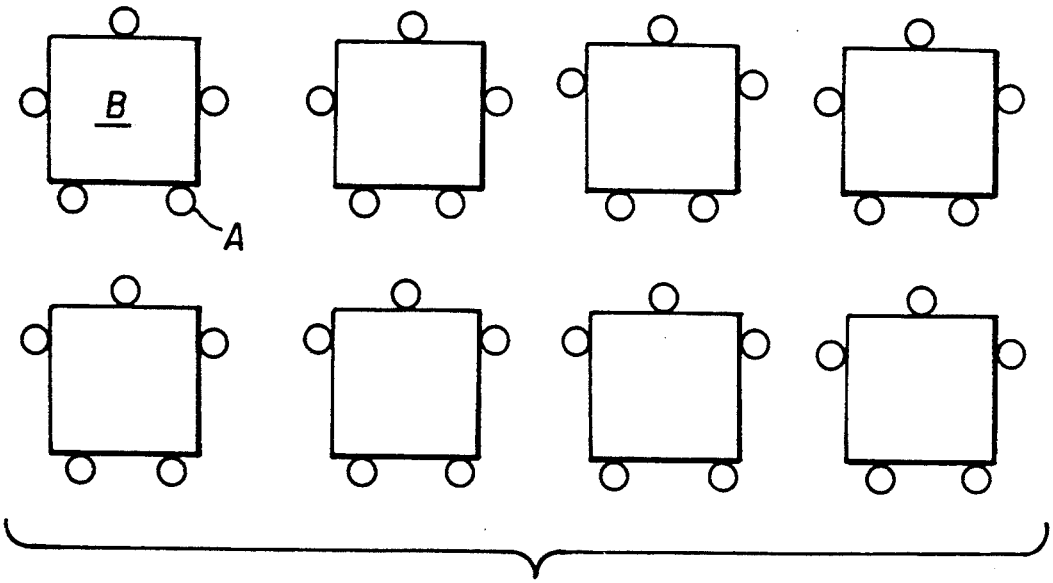
FIG. 1 is a schematic representation of a unimodal distribution of polymolecular association clusters.
Figure 2:
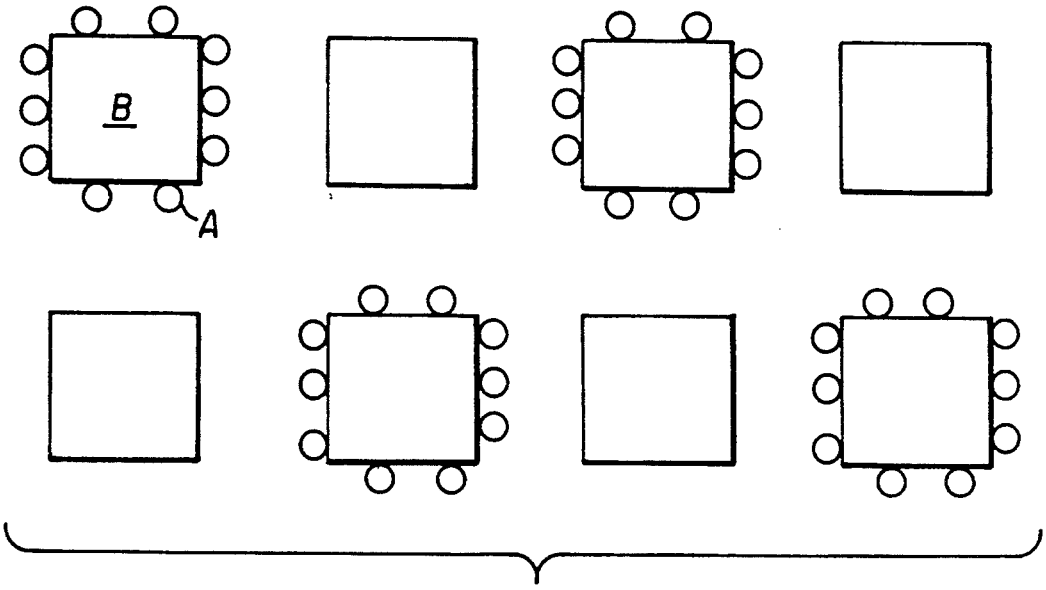
FIG. 2 is a schematic representation of a bimodal distribution of polynuclear association clusters.
Figure 3:
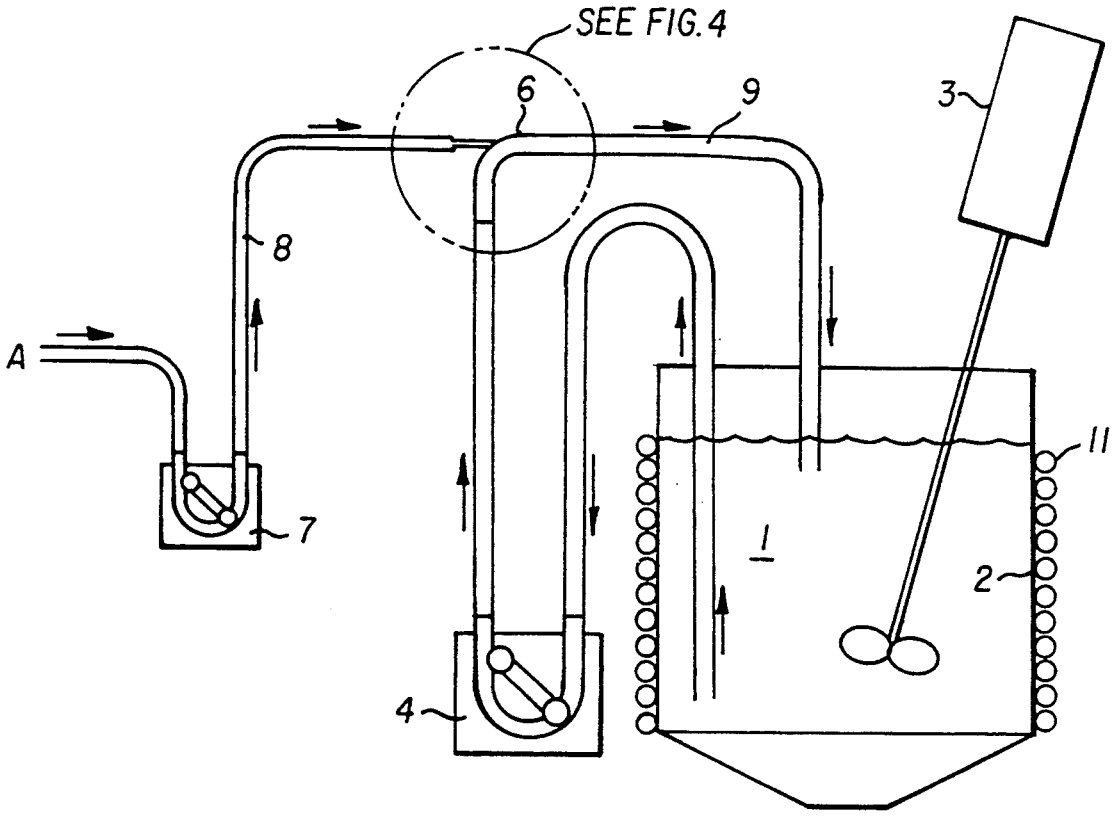
FIG. 3 is a schematic diagram of an apparatus according to the invention.
Figure 4:
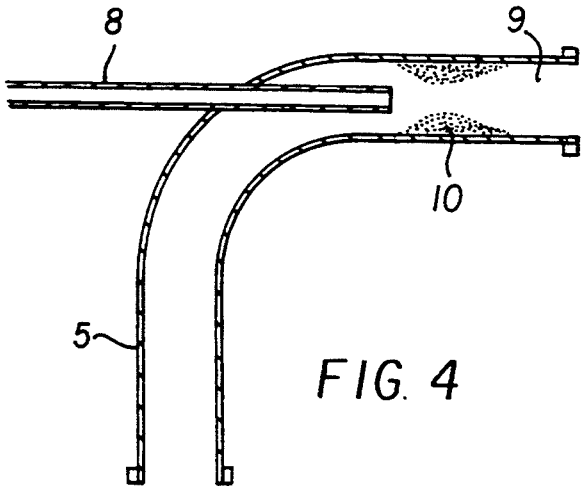
FIG. 4 is a cross-section of one embodiment of a reaction chamber according to the invention.

The process and apparatus of the invention are better understood by reference to FIG. 3 which shows a suspension 1 of particles B in a reactor vessel 2. The suspension is circulated in the vessel by mixer 3. The mixer can be a pitched-blade turbine or any of the many well known means for agitating a fluid. A pump 4 withdraws a portion of the suspension from the vessel 2 through conduit 5 and forces it through reaction chamber 6. The pump 4 shown in the figure is a peristaltic pump, but any type of controllable pump would function in the invention. A solution of reactant A is pumped by pump 7 through conduit 8 into reaction chamber 6. FIG. 4 shows a cross-section of a reaction chamber suitable for use in the invention. The particular chamber shown is a passive mixer of the Venturi type that utilizes the turbulence formed downstream of a constriction 10 to induce efficient mixing. It will be obvious to those in the art that any mixer could be used, either active or passive, and the method and apparatus are not restricted to that shown. From the reaction chamber 6, the mixed suspension B and reactant A are pumped through conduit 9 back into vessel 2. Conduits 5 and 9 and chamber 6 form the recirculation loop. The apparatus functions optimally when the length of the return conduit 9 is such that the reaction is substantially complete by the time the reaction is returned to the vessel, i.e. the volume, $V_R$, is greater than the flow rate $r_1$ divided by the forward reaction rate $k^1$. The reverse reaction rate $k^{-1}$ must be significantly less than the forward reaction. An optional means for regulating the temperature of the suspension 11 may be advantageously included and may comprise coils with a recirculating heat exchange fluid.

By controlling (1) the bulk agitation in the vessel, (2) the volume of the recirculation loop, (3) the number of times per unit time one batch volume passes through the recirculation loop, (4) the addition rate of the reactant, and (5) the reactant concentration, it is possible to control the statistical distribution of the exposure of emulsion grains to the reactant and thereby reproducibly obtain a complete spectrum of distributions from uniform to polymodal approaching random. A polymodal distribution may be thought of as arising from a set of conditions such that X% of the grains B in the batch never pass through the addition apparatus and therefore are never exposed to A, Y% pass through once, Z% pass through twice, etc. The process is particularly useful when the reaction taking place between A + B is fast but its application is not limited to such cases. The reaction must, however, be substantially irreversible.

The specific values of the constants E, F, P and Q in the equations above will depend on the distribution of products that is desired. An example of how the values of the constants E, F, P and Q can be manipulated to produce substantially different distributions is as follows:

If p is the probability of any given emulsion grain passing through the mixing chamber (a.k.a. an event) at any given time and n is the number of time units over which the reaction takes place, then $\eta = np$ = the mean frequency of events over time. Given the following assumptions:

1. p, which is a function of Q and F, is small;
2. n, which is equal to E/Q, is large;
3. P is set such that the vessel can be assumed to be perfectly mixed;
4. The reaction is irreversible and complete by the time the grain is returned to the vessel; and
5. $\eta = E$.

The distribution of the number of exposures versus the percent of all grains exposed follows a Poisson distribution which is described mathematically as:

$$P_r(y) = \frac{e^{-n}\eta^y}{y!} \quad (2)$$

Figure 5:
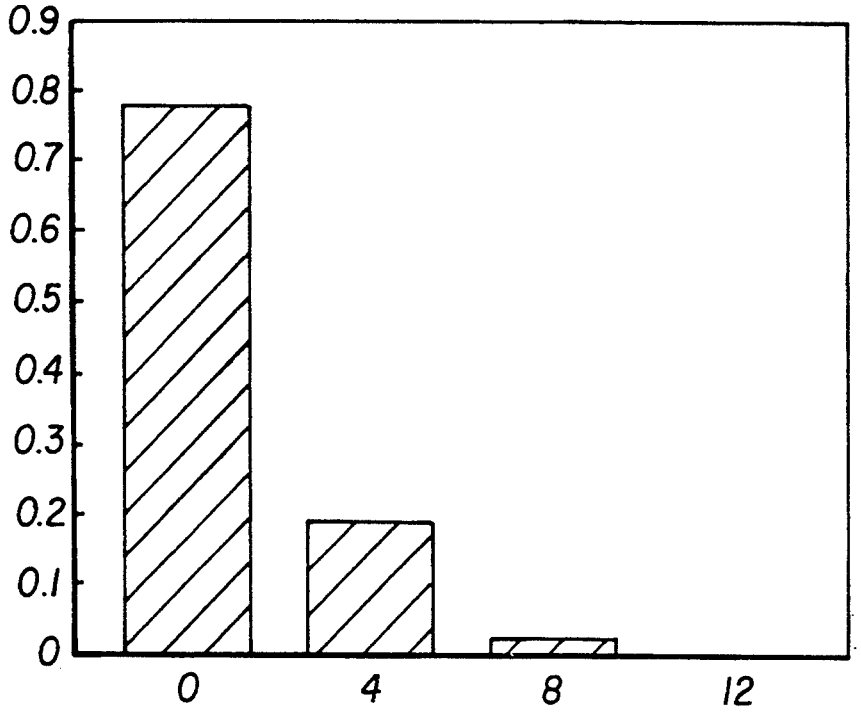
FIGS. 5–10 are graphs of particle distributions.
Figure 6:
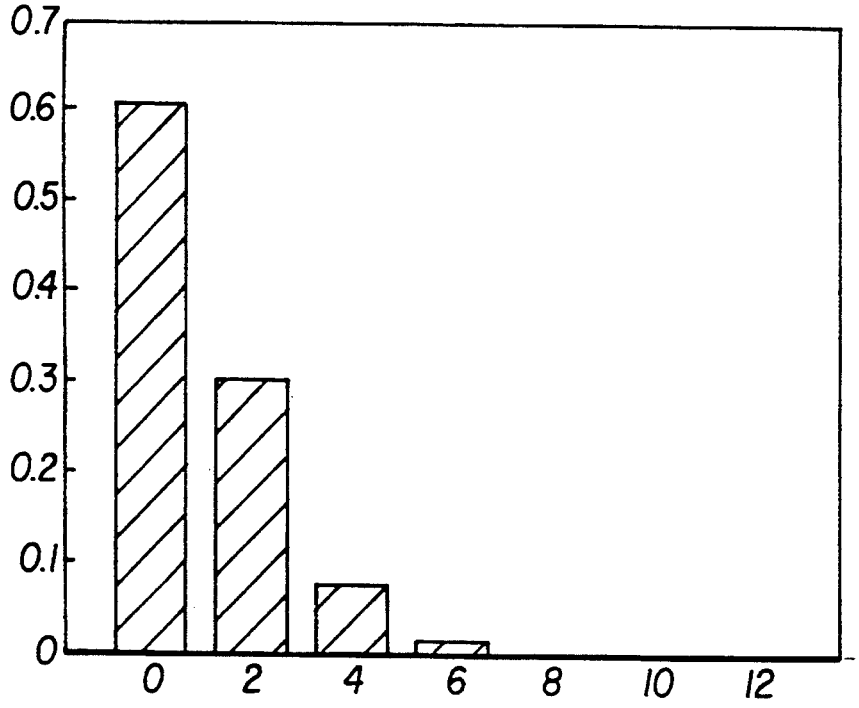
Figure 7:
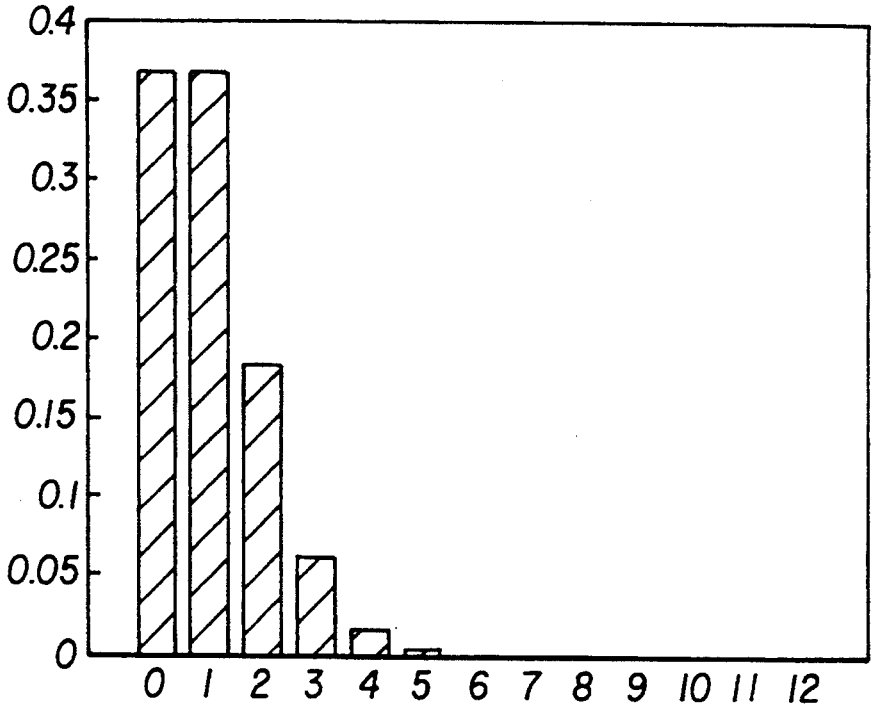
Figure 8:
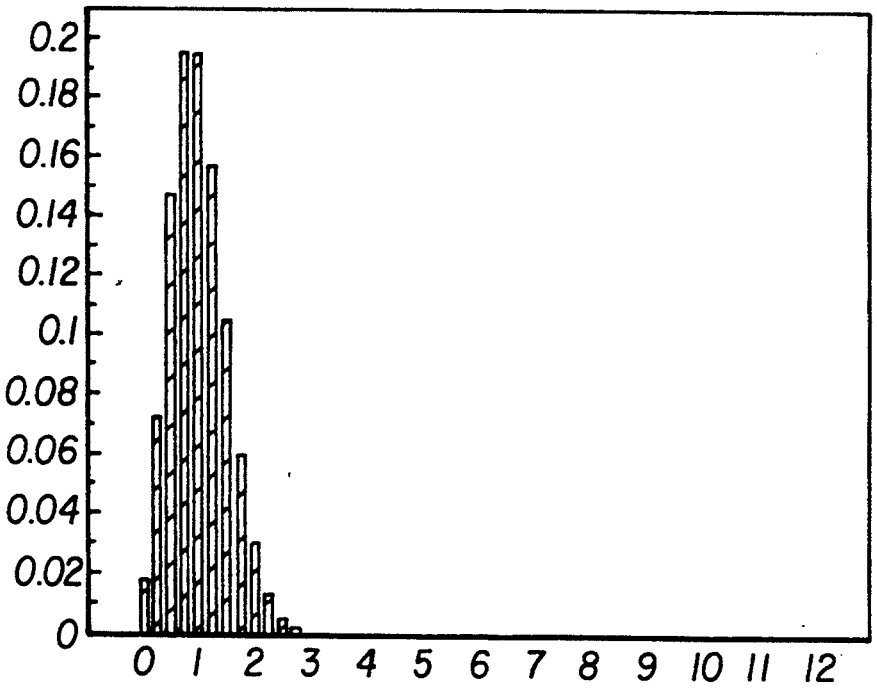
Figure 9:
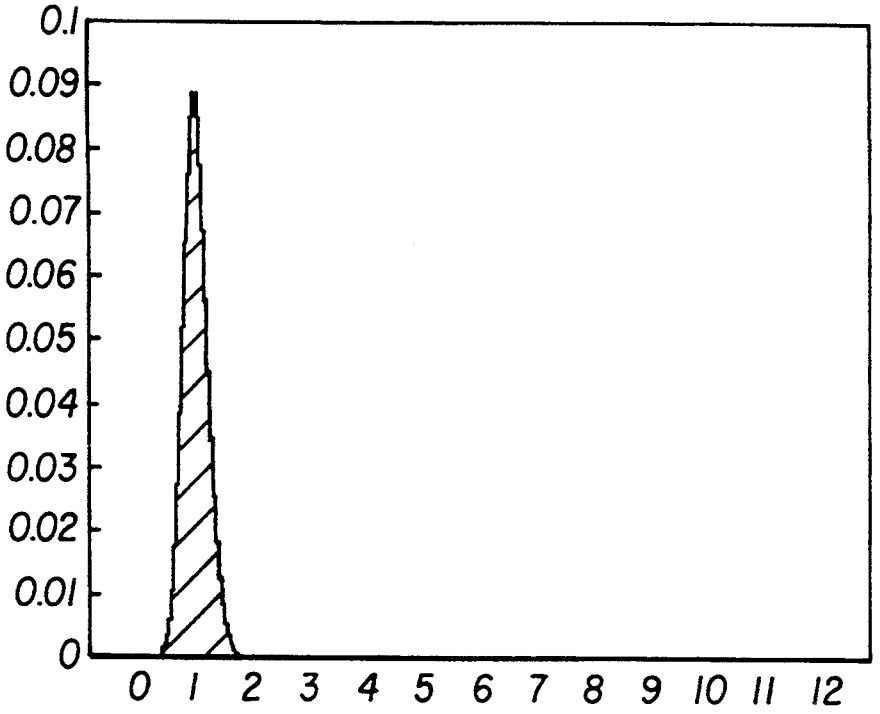
Figure 10:
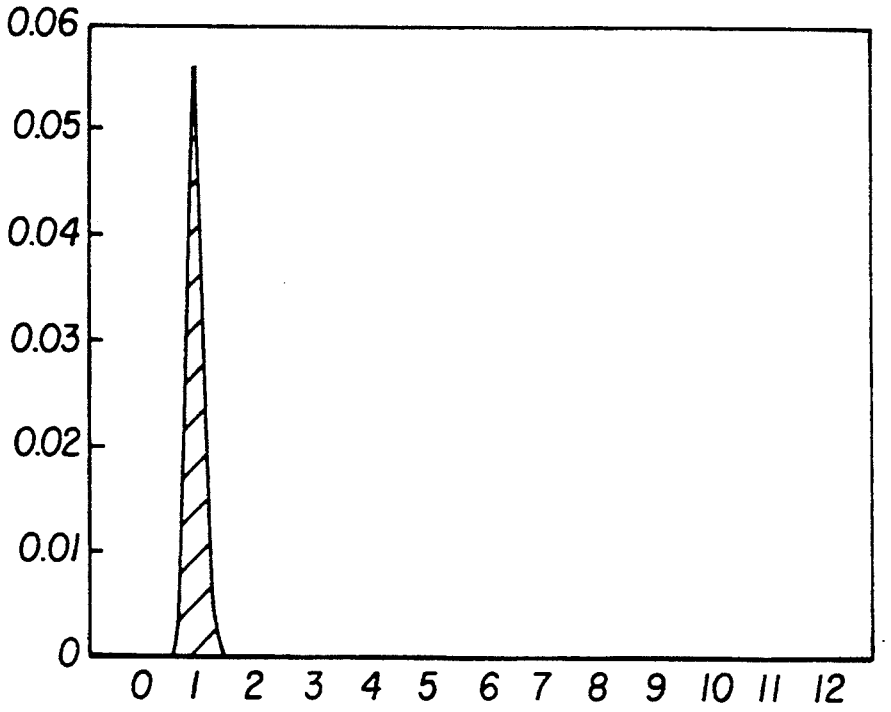

FIGS. 5–10 show the effect on the distribution of varying E while holding F, P and Q constant. For all graphs, the y-axis is the percent of all grains to receive that level of exposure. The x-axis represents the number of exposures for an individual grain divided by the mean number of exposures for all grains in the population. FIG. 5 shows the distribution resulting from setting E = 0.25; FIG. 6 is the distribution from E = 0.5; FIG. 7 is E = 1; FIG. 8 is E = 4; FIG. 9 is E = 20 and FIG. 10 is E = 50. With these assumptions the distribution is polymodal when E is less than 1 and approaches uniformity as E increases above 20.

Similar graphs could be constructed given other sets of assumptions about E, F, P and Q. Note also that the distribution is additionally affected by $C_B$ (the concentration of B) and the rates of association and dissociation of the two particular species, although the association and dissociation are not variables that can be significantly modulated. Choosing species A and B substantially fixes $k^1$ and $k^{-1}$. $C_B$ will have an effect, but it can be taken into account by modulating E, F, P and Q.

Although values can be calculated to provide various distributions, in the photographic art the correlation between distribution and sensitometric properties is often not known a priori, and it will be necessary to determine the preferred values of the appropriate constants empirically from the sensitometric properties of the product.

EXAMPLE 1

A silver halide photographic emulsion with a mean grain size of 0.35 microns and a halide ratio of 55 mole percent bromide to 45 mole percent chloride was prepared and chemically sensitized with 4 micromoles of sulfur and 8 micromoles of gold per mole of silver (Solution B). A methanol solution of a zwitterionic cyanine dye having a molecular weight of 651.62 was also prepared (Solution A).

Four and two-tenths liters of solution B was placed in a kettle and heated to 40 degrees C. while being agitated with a pitched blade turbine at a bulk agitation rate of 17 turnovers per minute. When the aim temperature was reached, a peristaltic pump was turned on, which circulated Solution B through a 0.23 mL mixing chamber at a rate equal to 9.6% of the total volume per minute. When Solution B was circulating at a constant rate, 34 micromoles of Solution A per mole of silver in Solution B was pumped with a piston pump into the mixing chamber through the addition port at a constant rate over 9.44 minutes.

EXAMPLE 2

A comparison emulsion was prepared according to the common practice of placing Solution B into the kettle and heating it to 40 degrees C. with agitation provided by a pitched blade turbine running at 5.67 turnovers per minute. Solution A was pumped into Solution B with the discharge point immediately above the turbine blades. The addition was made at a constant rate over 9.44 minutes.

EXAMPLE 3

The procedure of example 1 was followed except that the rate of flow, $r_2$, of the solution A was decreased to a constant rate over 35.62 minutes.

EXAMPLE 4

The procedure of example 2 was followed except that the number of turnovers per minute was increased 3-fold to 17.

Additional gel was added to each of the emulsions and they were coated with suitable addenda on a polyethylene coated paper support to give a coverage of 120 mg of silver per square foot. Samples of each were exposed for four seconds through a Wratten 5 filter. The exposed elements were processed for 60 seconds at 20 degrees C. in Kodak DEKTOL TM black and white paper developer, stopped, fixed, washed, and dried. The results are shown in the following table.

TABLE 1

| Emulsion | Contrast | Change in contrast |
|---|---|---|
| example 1 | 1.34 | |
| example 2 | 1.89 | |
| example 3 | 1.57 | 0.23 |
| example 4 | 3.31 | 1.42 |

The results demonstrate two features of the inventive process: First, comparing examples 1 and 2 it can be seen that the desired decrease in contrast is obtained. Second, comparing example 1 with example 3 and example 2 with example 4, it can be seen that the process is much less sensitive to perturbation. This is also reflected in significantly lower batch-to--batch variation under the same control parameters.

While the invention has been particularly shown and described with reference to preferred embodiments thereof, it will be understood by those skilled in the art that other changes in form and details may be made therein without departing from the spirit and scope of the invention.

We claim:

1. A method for the reproducible production of non-uniform distributions of polymolecular association clusters, each of said clusters comprising a plurality of a species A in association with a single species B, said association cluster arising from a reaction of the form $$nA + B \underset{k^{-1}}{\overset{k^1}{\rightleftharpoons}} BA_n$$

wherein n is an integer, $k^1$ is the rate of forward reaction, $k^{-1}$ is the rate of reverse reaction, and $k^1 >> k^{-1}$, said method comprising:

(a) mixing at a rate of P turnovers per minute a suspension of particles of species B at concentration $C_B$ in a suitable solvent of volume V in a vessel;

(b) flowing a portion of said suspension through an isolated reaction zone at a rate $r_1 = QV$ per minute for x minutes where Q represents a proportion of the total vessel volume to be passed through said zone per minute, and X is (1/Q) E wherein E represents a number of cycles of full vessel volume to be passed through said isolated reaction zone;

(c) introducing species A into said isolated reaction zone at a rate $r_2 = FC_BV$ per minute, where F represents a desired mole ratio of reactant A to be added; and (d) returning said portion of said suspension including said introduced species A to said vessel, whereby a non-uniform distribution of polymolecular association clusters is formed;

said constants E, F, P and Q being chosen such that E is a number from 0.01 to 100, F is a number from $10^{-8}$ to $10^{-1}$, P is a number from 0 to 100, and Q is a number from 0.001 to 10.

2. A method according to claim 1 wherein said species A is a photographically active compound and B is a particle of silver halide.

3. A method according to claim 2 wherein said species A is a dye and species B is silver halide having a mean grain size of 0.1 to 10 $\mu$m.

4. A method according to claim 3 wherein E is 0.25 to 2.5, F is $10^{-6}$ to $10^{-3}$, P is 2 to 30 and Q is 0.02 to 2.0.

5. A method for the reproducible production of uniform distributions of polymolecular association clusters, each of said clusters comprising a plurality of a species A in association with a single species B, said association cluster arising from a reaction of the form $$nA + B \underset{k^{-1}}{\overset{k^1}{\rightleftharpoons}} BA_n$$

wherein n is an integer, $k^1$ is the rate of forward reaction, $k^{-1}$ is the rate of reverse reaction, and $k^1 >> k^{-1}$, said method comprising:

(a) mixing at a rate of P turnovers per minute a suspension of particles of species B at concentration $C_B$ in a suitable solvent of volume V in a vessel;

(b) flowing a portion of said suspension through an isolated reaction zone at a rate $r_1 = QV$ per minute for x minutes where Q represents a proportion of the total vessel volume to be passed through said zone per minute, and X is (1/Q) E wherein E represents a number of cycles of full vessel volume to be passed through said isolated reaction zone;

(c) introducing species A into said isolated reaction zone at a rate $r_2 = FC_BV$ per minute, where F represents a desired mole ratio of reactant A to be added; and (d) returning said portion of said suspension including said introduced species A to said vessel, whereby a uniform distribution of polymolecular association clusters is formed;

said constants E, F, P and Q being chosen such that E is a number from 0.01 to 100, F is a number from $10^{-8}$ to $10^{-1}$, P is a number from 0 to 100, and Q is a number from 0.001 to 10.

6. A method according to claim 5 wherein said species A is a photographically active compound and B is a particle of silver halide.

7. A method according to claim 6 wherein said species A is a dye and species B is silver halide having a mean grain size of 0.1 to 10 μm.

8. A method according to claim 7 wherein E is 0.25 to 2.5, F is $10^{-6}$ to $10^{-3}$, P is 2 to 30 and Q is 0.02 to 2.0.

* * * * *